US005165245A

United States Patent [19]

Agrawal et al.

[11] Patent Number: 5,165,245

[45] Date of Patent: Nov. 24, 1992

[54] ELEVATED PRESSURE AIR SEPARATION CYCLES WITH LIQUID PRODUCTION

[75] Inventors: Rakesh Agrawal, Allentown; Jianguo Xu, Fogelsville, both of Pa.

[73] Assignee: Air Products and Chemicals, Inc., Allentown, Pa.

[21] Appl. No.: 700,021

[22] Filed: May 14, 1991

[51] Int. Cl.[5] ..... F25J 3/00; F25J 3/02

[52] U.S. Cl. ..... 62/38; 62/24; 62/31; 62/34

[58] Field of Search ..... 62/24, 31, 34, 38, 39, 62/44

[56] References Cited

U.S. PATENT DOCUMENTS

| | | | |
|---|---|---|---|
| 4,433,989 | 2/1984 | Erickson | 62/31 X |
| 4,526,595 | 7/1985 | McNeil | 62/34 X |
| 4,543,115 | 9/1985 | Agrawal et al. | 62/31 X |
| 4,560,397 | 12/1985 | Cheung | 62/31 X |
| 4,604,116 | 8/1986 | Erickson | 62/31 X |
| 4,704,147 | 11/1987 | Kleinberg | 62/24 |
| 4,732,597 | 3/1988 | Jujasz et al. | 62/24 |
| 4,783,210 | 11/1988 | Ayres et al. | 62/24 |
| 4,790,866 | 12/1988 | Rathbone | 62/24 X |
| 4,883,516 | 11/1989 | Layland et al. | 62/24 X |
| 4,883,517 | 11/1989 | Rathbone | 62/24 X |
| 4,895,583 | 1/1990 | Flanagan et al. | 62/24 |
| 4,916,908 | 4/1990 | Lavin et al. | 62/24 X |
| 4,966,002 | 10/1990 | Parker et al. | 62/31 |

*Primary Examiner*—Henry A. Bennet
*Assistant Examiner*—Christopher Kilner
*Attorney, Agent, or Firm*—Willard Jones, II; William F. Marsh; James C. Simmons

[57] ABSTRACT

The present invention relates to an improvement to a cryogenic process for the separation of air into its constituent components. In the process, a distillation column system having at least two distillation columns, a high pressure distillation column and a low pressure column is used; these two distillation columns are in thermal communication with each other. The low pressure column of the distillation column system operates at a pressure between 9 to 75 psig and a nitrogen product is produced from the top section thereof. At least 50% of the air to the distillation column system is removed as this nitrogen product, which has a nitrogen concentration of at least 95% and is at a pressure of at least 9 psig.

The improvement to the process is a series of steps which allows for the production of liquid products from the cryogenic process in an efficient manner. These steps are primarily the partial warming of the nitrogen product, its subsequent isentropic expansion and use of the inherent refrigeration of the expanded nitrogen. These steps can be carried out in three ways.

10 Claims, 10 Drawing Sheets

LIN
LOX
LAR
400
600
242
241
398
500
918
916
914
920
143
133
906
65
3
4
117
122
124
902
904
908
912
5
130
80
54
64
63
66
68
910
62
PLAR
195
135
934
935
936
110
932
930
AIR
101
GOX
194
HPGAN
139
LPGAN
148
REG
243
900
924
144
134

LIN
LOX
LAR
400
600
242
241
398
500
918
916
914
920
143
906
65
4
117
122
124
902
5
130
80
54
64
63
66
68
904
908
912
120
910
62
135
195
110
934
936
932
930
AIR
101
GOX
194
HPGAN
139
LPGAN
148
REG
243
900
133
134
924

ELEVATED PRESSURE AIR SEPARATION CYCLES WITH LIQUID PRODUCTION

TECHNICAL FIELD

The present invention is related to a cryogenic process for the distillation of air into its constituent components while operating the distillation columns of the process at elevated pressure.

BACKGROUND OF THE INVENTION

Particular applications for the constituent components of air often require that components be produced as liquid products from the air separation plant. Elevated pressure cryogenic air separation cycles have the advantages of smaller equipment size and smaller diameter pipelines, as well as energy loss due to pressure drops across these pipelines and equipment. Unfortunately, nitrogen produced by an elevated pressure air separation plant is typically at a higher pressure than is required for its use. The energy of this surplus pressure of the nitrogen from an elevated pressure cycle can be utilized to produce liquid products. With the availability of this excess pressure energy the quest is to find more efficient ways of utilizing the pressure energy of the nitrogen product from elevated pressure cycles.

The conventional way of making liquid oxygen and/or liquid nitrogen is to add a liquefier to the low pressure cycle air separation unit in which the low pressure column operates in the pressure range of about 2–9 psig. The liquefier may be integrated into the air separation plants, such as is shown in U.S. Pat. No. 4,152,130 in which compressed air is expanded to provide the refrigeration needed for liquefaction. Air expansion cycles have the disadvantage that if large quantities of liquid nitrogen product are required, then argon and oxygen recoveries will severely suffer.

U.S. Pat. No. 4,705,548 teaches the use of heat pumping with nitrogen to help solve this recovery problem, but, unfortunately, this heat pumping step introduces inefficiencies by increasing exergy loss in heat exchangers and increases capital cost.

Great Britain Pat. No. 1,450,164 suggests increasing the operational pressure of the air separation unit thereby producing an increased pressure nitrogen product and then using this pressure energy to supplement the refrigeration needed for the production of liquid oxygen. This cycle is not efficient because of the unnecessary degree of energy degradation in utilizing the refrigeration produced by expansion of the pressurized nitrogen.

Another problem of conventional air separation plants is that typically large amounts of waste nitrogen are used for producing chilled water, which needs to be at a pressure very close to atmospheric pressure (e.g. about 0.5 psi higher than atmospheric pressure), and for regeneration of the mole sieve beds, which needs to be at a pressure 1–3 psi higher than atmospheric pressure. Conventionally, both streams are produced from the low pressure column, with the pressure of the low pressure column being set by the pressure of the mole sieve regeneration stream, resulting in a higher column pressure and therefore a higher discharge pressure from the main air compressor. The other way to set the pressure of the low pressure column is according to the water chilling nitrogen stream pressure and compress the regeneration stream to the required pressure. This solution requires more capital since the regeneration stream pressure booster and after-cooler adds to the capital cost.

BRIEF SUMMARY OF THE INVENTION

The present invention relates to an improvement to a cryogenic process for the separation of air into its constituent components. In the process, a distillation column system having at least two distillation columns, a high pressure distillation column and a low pressure column is used; these two distillation columns are in thermal communication with each other. The low pressure column of the distillation column system operates at a pressure between 9 to 75 psig and a nitrogen product is produced from the top section thereof. At least 50% of the air to the distillation column system is removed as this nitrogen product, which has a nitrogen concentration of at least 95% and is at a pressure of at least 9 psig.

The improvement to the process is a series of steps which allows for the production of liquid products from the cryogenic process in an efficient manner. These steps are primarily the partial warming of the nitrogen product, its subsequent near isentropic expansion and use of the inherent refrigeration of the expanded nitrogen. These steps can be carried out in three ways.

The first comprises the steps of: (a) partially warming the nitrogen product by heat exchange against a suitable process stream; (b) isentropically expanding this partially warmed, nitrogen product in an expander so as a result of this expansion the temperature of the expanded nitrogen is at a lower temperature than the temperature of liquid streams which are removed from the high pressure column; and (c) subcooling the liquid streams removed from the high pressure column by heat exchange against the isentropically expanded nitrogen prior to isenthalpic reduction of the pressures of such liquid streams across a valve.

The second way comprises the steps of: (a) partially warming the nitrogen product by heat exchange against a suitable process stream; (b) isentropically expanding this partially warmed, nitrogen product in an expander so as a result of this expansion the temperature of the expanded nitrogen is at or below the dew point of the feed air to the double column distillation system; and (c) cooling and possibly condensing the feed air by heat exchange against the isentropically expanded nitrogen.

The third way is a division of the nitrogen product into two substreams and using one of the substreams to carry out the first group of steps and the other substream to carry out the second group of steps.

DETAILED DESCRIPTION OF THE INVENTION

Figure 1:
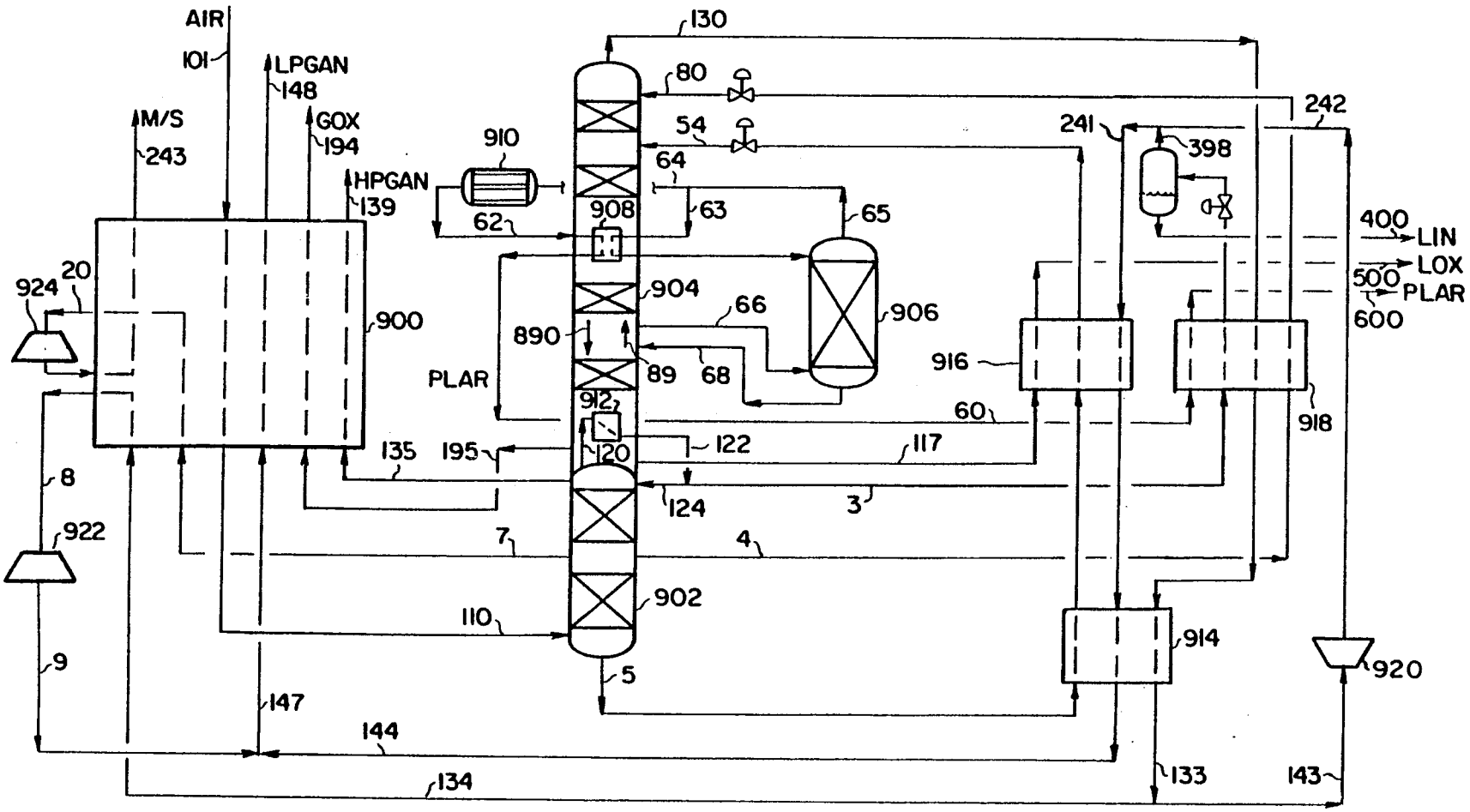
FIGS. 1 through 8 and 10 are schematic diagrams of several embodiments of the process of the present invention.

The present invention is an improvement to a cryogenic air separation process utilizing a distillation column system having at least two columns wherein the operational pressure of the low pressure column is increased above the conventional 2–9 psig pressure. With the pressure of the low pressure column between 9 to 75 psig, a low pressure column nitrogen product is produced at similar pressures. Moreover, at least 50% of the incoming air to the air separation plant is removed as this low pressure column nitrogen product; the removed nitrogen product has a nitrogen concentration of at least 95% and is at a pressure of at least 9 psig. A significant fraction of this elevated pressure nitrogen from the distillation column is isentropically expanded in an expander at a cryogenic temperature to provide refrigeration for the production of liquid nitrogen and/or liquid oxygen and/or liquid argon.

The improvement comprises the manner in which the elevated pressure nitrogen is isentropically expanded in one (or more) expander(s) at cryogenic temperature. Preferably, this expansion is accomplished in one of the following two ways:

(1) partially heating the nitrogen product removed from the low pressure column of a double column distillation system by heat exchange against a suitable process stream, isentropically expanding this partially warmed, low pressure column nitrogen in an expander so as a result of this expansion the temperature of the expanded nitrogen is at a lower temperature than the temperature of liquid streams which are removed from the high pressure column of the double column distillation system, and subcooling the liquid streams removed from the high pressure column by heat exchange against the isentropically expanded nitrogen prior to isenthalpically reducing the pressures of such liquid streams across a valve; or (2) partially heating the nitrogen product removed from the low pressure column of a double column distillation system by heat exchange against a suitable process stream, isentropically expanding this partially warmed, low pressure column nitrogen in an expander so as a result of this expansion the temperature of the expanded nitrogen is at or below the dew point of the feed air to the double column distillation system, and cooling and possibly partially condensing the feed air by heat exchange against the isentropically expanded nitrogen.

The above two methods of expansion can be combined and two or more expanders be used for expansion of the elevated pressure nitrogen streams.

Another aspect of the invention is to separately produce an air cleaning bed regeneration stream from other nitrogen products produced by an elevated pressure cycle. This regeneration stream may be expanded from a high pressure column nitrogen product or from a low pressure column nitrogen product. There are numerous ways these two methods of producing a regeneration stream can be incorporated into the cycle.

FIGS. 1–8 and FIG. 10 are the flow diagrams depicting some of the possible embodiments of the process of the present invention. The embodiments shown in FIGS. 1–4 are respectively referred to as the LEP, SEP, BEP and EP cycles.

The embodiments of FIGS. 1–8 and FIG. 10 have numerous common features. For ease of understanding, these features, which present the primary cryogenic distillation portion of the cycles, will be described now. With reference to the subject figures, compressed feed air, which has had any particulate matter, water, carbon dioxide and other components which freeze at cryogenic temperatures removed, is fed to main heat exchanger 900, via line 101, for cooling to a temperature close to its dew point. This cooled, feed air is then fed, via line 110, to high pressure column 902 for rectification into a high pressure nitrogen overhead and an oxygen-rich bottoms liquid.

A part of the high pressure nitrogen overhead is removed from high pressure column 902, via line 120, and totally condensed in reboiler-condenser 912, located in the bottom of low pressure column 904 against boiling liquid oxygen. The totally condensed high pressure liquid nitrogen is removed from reboiler-condenser 912, via line 122 and split into two portions. The first portion is returned to the top of high pressure column 902, via line 124, as liquid reflux. The second portion, line 3, is subcooled and flashed. The resulting liquid portion is removed from the process, via line 400, as liquid nitrogen product. The remaining part of the high pressure nitrogen overhead is removed from high pressure column 902, via line 135, warmed in main heat exchanger 900 to recover refrigeration and removed as high pressure nitrogen product, via line 139.

The oxygen-rich bottoms liquid is removed from high pressure column 902, via line 5, subcooled, flashed and then fed, via line 54, to the appropriate location of low pressure column 904 for distillation into a low pressure column nitrogen overhead and liquid oxygen bottoms.

At least a portion of the liquid oxygen bottoms is vaporized in reboiler-condenser 912 to provide boil-up for low pressure column 904. The remaining portion of the liquid oxygen bottoms can be removed from low pressure column 904, via line 117, and subcooled thereby producing liquid oxygen product in line 500. A portion of the vaporized oxygen from reboiler-condenser 912 is removed from low pressure column 904, via line 195, and warmed in main heat exchanger 900 to recover refrigeration, thereby producing gaseous oxygen product in line 194. This gaseous oxygen product, line 194, can be further compressed to reach the desired pressure; this oxygen compression procedure is not shown.

The embodiments shown in the subject figures also produce pure liquid argon product. To do so, an argon-containing vapor side stream is removed, via line 66, from an intermediate and appropriate location of low pressure column 904 and fed to the bottom of argon column 906 for rectification into an argon overhead containing less than 5000 vppm oxygen and an argon-containing bottoms liquid. The argon-containing bottoms liquid is removed from argon column 906, via line 68, and returned to low pressure column 904. The argon overhead is removed from argon column 906, via line 65, and split into two portions. The first portion, line 63, is condensed in reboiler-condenser 908 and returned to the top of argon column 906 as liquid reflux. The second portion, line 64, is purified in adsorber 910 thereby producing a pure argon product. This pure argon product, line 62, is then condensed in reboiler-condenser 908, subcooled and removed from the process as pure liquid argon product, via line 600. It should be mentioned that the argon product stream can be purified by technologies other than the adsorption technology discussed above. Examples of these other technologies are "de-oxo" systems or "getter" systems to remove oxygen and distillation to remove nitrogen. Reboiler-condenser 908 is located in low pressure column 904 between side stream draw, line 66, and oxygen-rich liquid feed, line 54. The precise location is chosen so as to provide sufficient refrigeration for the required condensation. In reboiler-condenser 908, this refrigeration is provided by boiling liquid descending low pressure column 904 thereby producing additional boil-up for the upper sections of low pressure column 904. It is worth noting that other known schemes can be used to supply reflux for argon column 906. For example, a portion of the argon overhead, line 63, can be condensed against a portion of the oxygen-rich bottoms liquid, line 5.

Finally, to provide liquid reflux for low pressure column 904, an oxygen-lean liquid side stream is removed, via line 4, from an intermediate location of high pressure column 902, subcooled, flashed and fed, via line 80, to low pressure column 904.

As mentioned earlier, the improvement of the present invention is the way the elevated nitrogen stream, line 130, produced at the top of low pressure column 904 is utilized to efficiently and effectively produce and recover refrigeration. This utilization will now be discussed with reference to several specific embodiments thereof.

With reference to FIG. 1, the LEP cycle, an elevated pressure nitrogen stream, line 130, produced at the top of low pressure column 904 is warmed, in subcooler 918, by heat exchange against an oxygen-lean liquid stream, line 4, which is withdrawn from an intermediate location of high pressure column 902 and fed as liquid reflux, via line 80, to low pressure column 904, and a liquid nitrogen stream, line 3, and, in subcooler 914, against the oxygen-rich bottoms liquid, line 5. This warmed nitrogen stream, line 133, is then split into two portions. The first portion, line 143, is isentropically expanded in expander 920 and this expander effluent, line 242, and vapor, line 398, from the flash of the liquid nitrogen, line 3, are combined. This combined stream, line 241, is used to subcool the oxygen-rich bottoms liquid, line 5, in subcoolers 914 and 916. The second portion, line 134, is further warmed in main heat exchanger 900 and expanded in expander 922. This expander effluent, line 9, is combined with the warmed nitrogen from subcooler 914, line 144. This combined low pressure nitrogen, line 147, is warmed in heat exchanger 900 to recover refrigeration and removed from the process as low pressure gaseous nitrogen product, via line 148. This low pressure gaseous nitrogen product stream 148 can be used for water chilling in a waste tower (not shown).

The regeneration stream for the air cleaning molecular sieve beds, line 243, for this cycle, is removed as a side stream from high pressure column 902, via line 7. If desired, this regeneration stream could also be removed from the top of high pressure column 902. This side stream is warmed to a suitable expansion temperature in main heat exchanger 900, expanded in expander 924 and further warmed in main heat exchanger to recover any refrigeration produced in the expansion.

Figure 2:
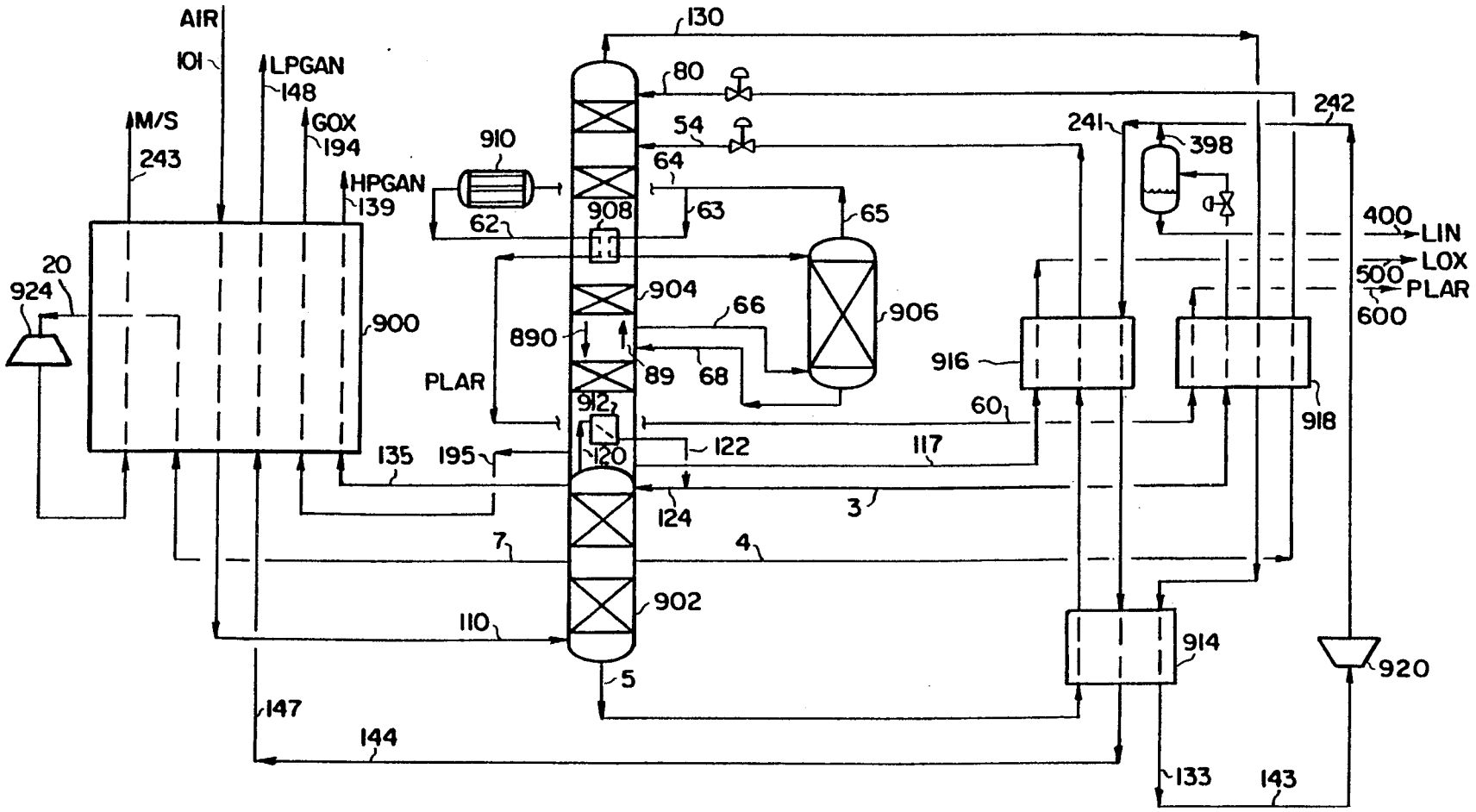

With reference to FIG. 2, the SEP cycle, all of the warmed, elevated pressure nitrogen, line 133, is expanded in expander 920. The remainder of the cycle is essentially as shown in FIG. 1.

Figure 3:
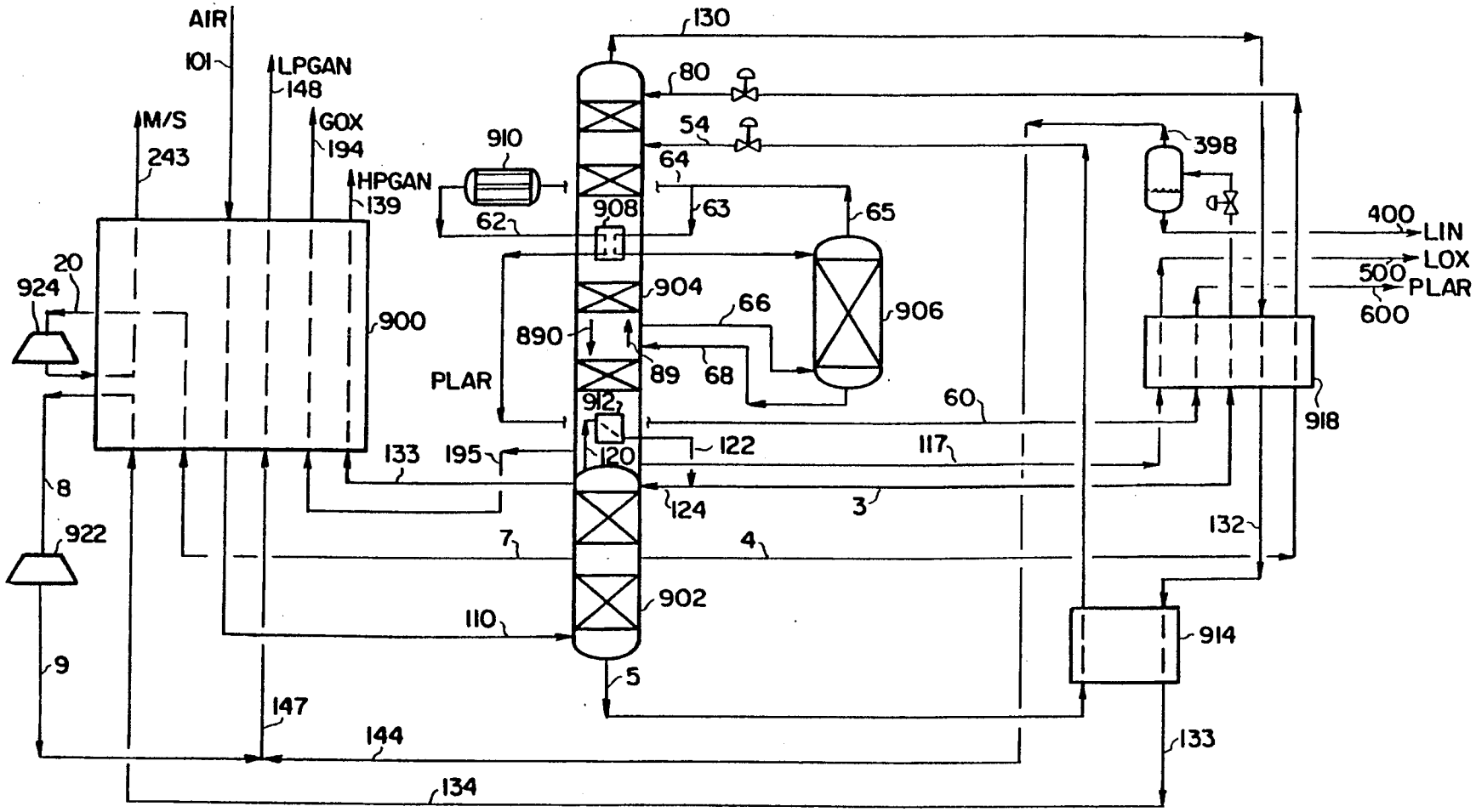

With reference to FIG. 3, the BEP cycle, all of the warmed, elevated pressure nitrogen, line 133, is further warmed in main heat exchanger 900 before expansion in expander 922. The expanded nitrogen, line 9, is combined with the nitrogen vapor, line 398, from the flashed liquid nitrogen, line 3, and the combined stream is warmed in main heat exchanger 900 to recover refrigeration.

Figure 4:
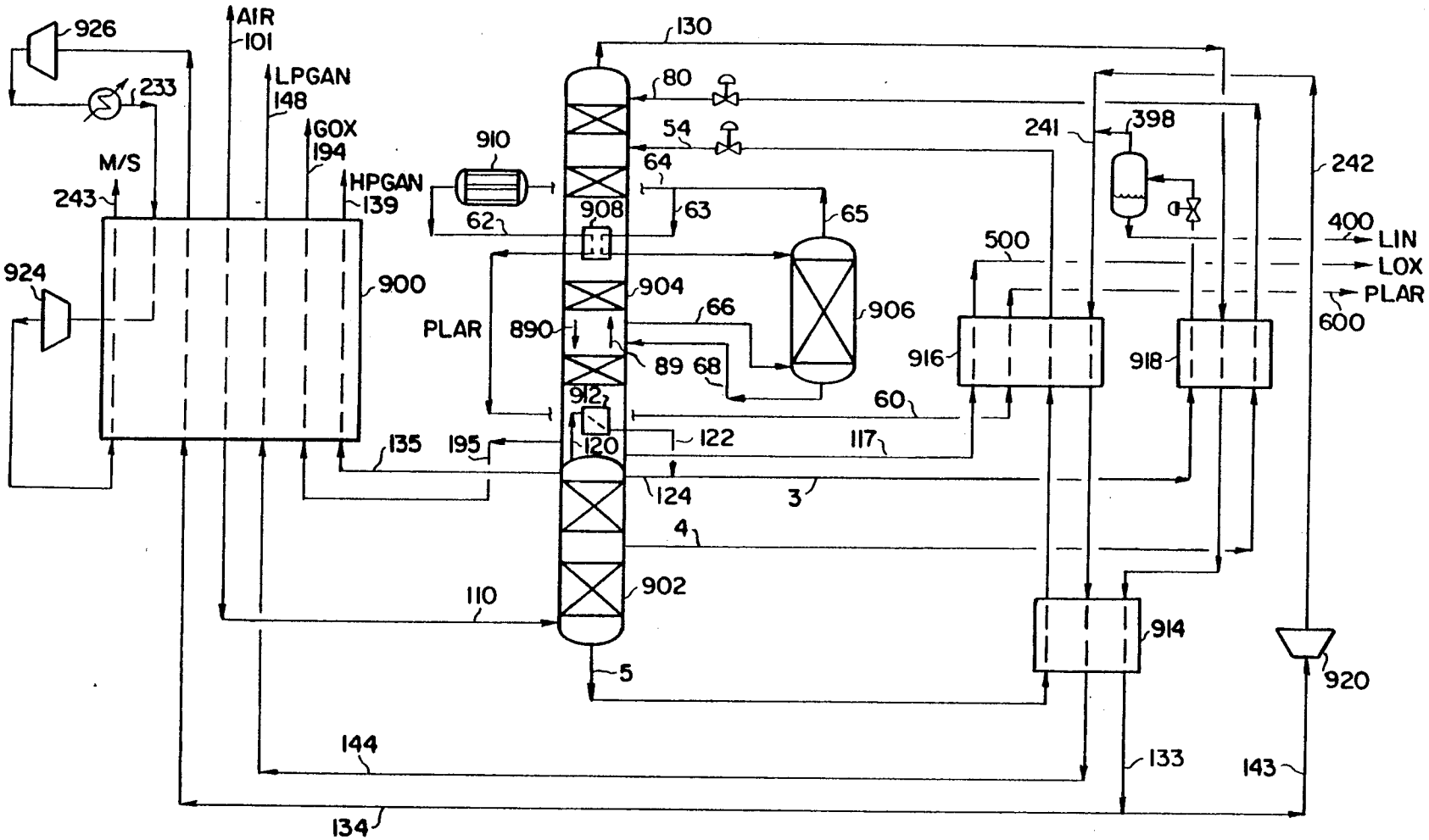

With reference to FIG. 4, the EP cycle, the warmed nitrogen line 133, is then split into two portions. The first portion, line 143, is isentropically expanded in expander 920 and this expander effluent, line 242, and vapor, line 398, from the flash of the liquid nitrogen, line 3, are combined. This combined stream, line 241, is used to subcool the oxygen-rich bottoms liquid, line 5, in subcoolers 916 and 914, then warmed in main heat exchanger 900 to recover refrigeration and finally removed as low pressure nitrogen product, via line 148. The second portion, line 134, is further warmed in main heat exchanger 900 and compressed in compressor 926. This warmed, compressed second portion, line 233, is cooled in main heat exchanger 900 to an appropriate expansion temperature and expanded in expander 924. This expanded stream, line 243, is warmed to recover refrigeration and removed as the mole sieve beds regeneration stream. Note that no high pressure nitrogen is expanded from the high pressure column. This cycle is particularly suitable when argon is the desired product.

Figure 5:
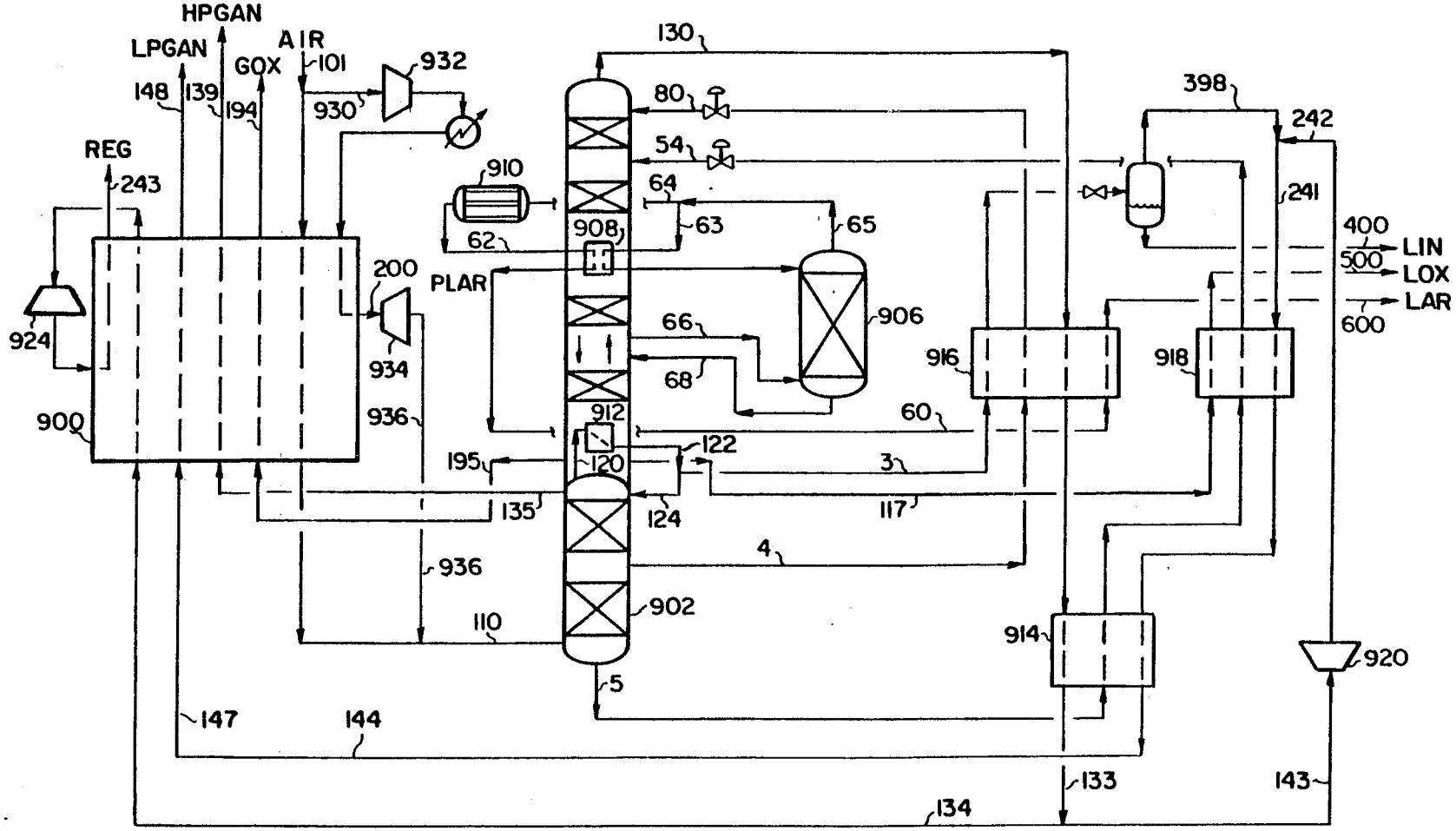
Figure 6:
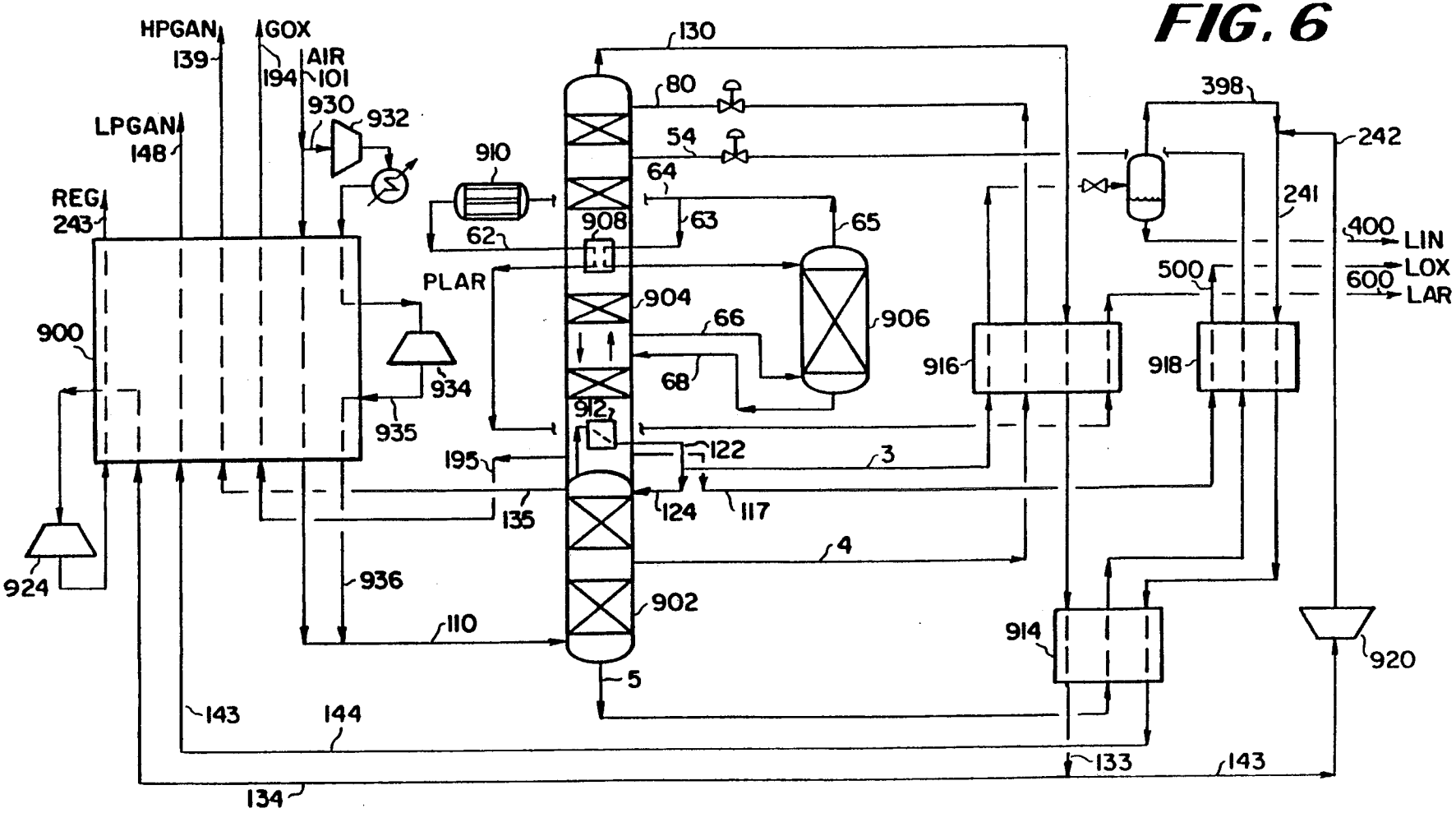
Figure 7:
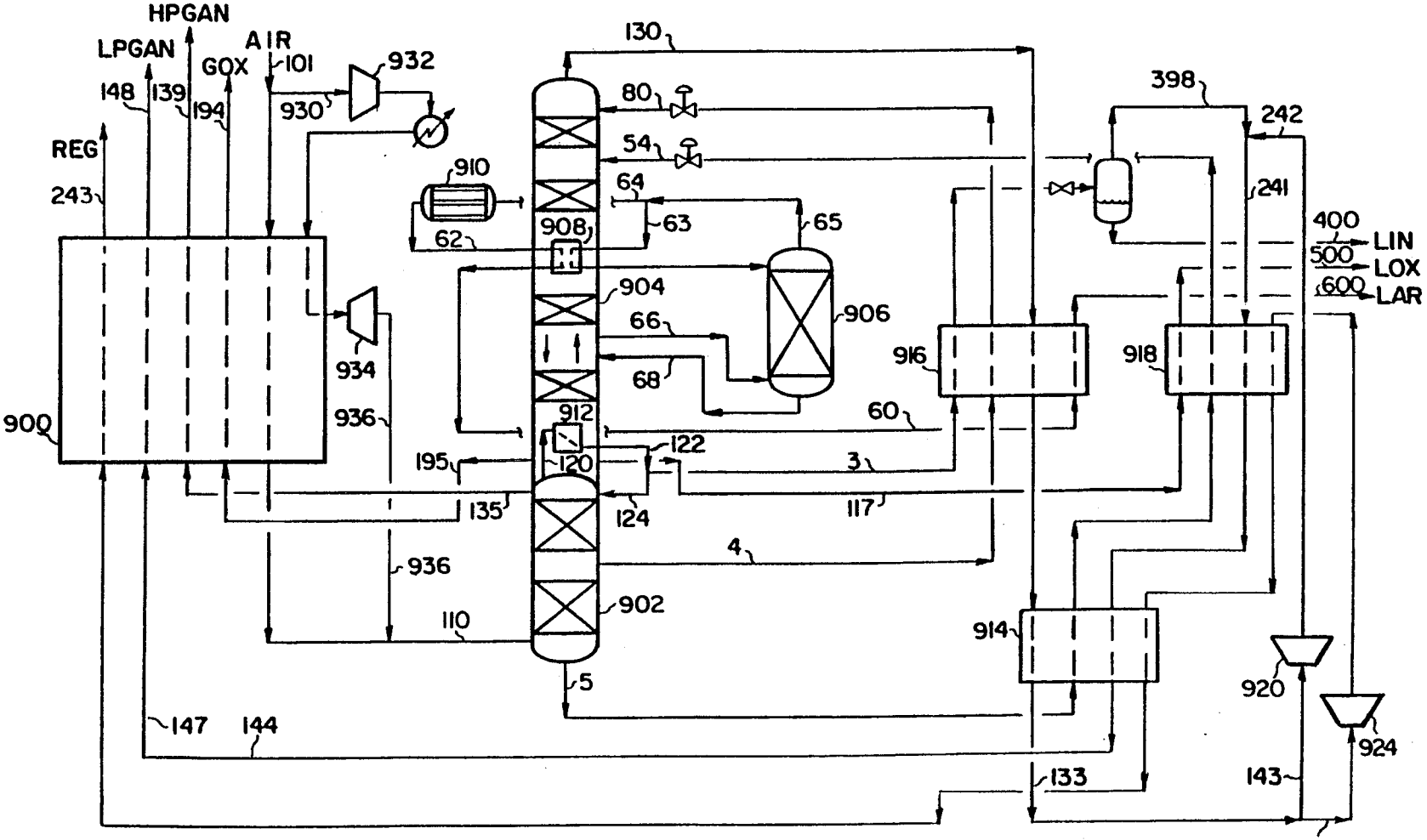

Variations of the embodiment shown in FIG. 4, the EP cycle, are shown in FIGS. 5–7. These variations, however, do not exhaust all the possible combinations. The cycles shown in FIGS. 5–7 require three expanders. In these cycles, a fraction, line 930, (typically 5–20%) of the feed air, is further compressed in compressor 932 and then cooled in main heat exchanger 900. The cooled, compressed fraction is removed from main heat exchanger 900 at either an interim location or the bottom and isentropically expanded in expander 934. The expanded feed air fraction, line 936, can be combined with the cooled feed air and fed, via line 110, to high pressure column 902 or fed directly to low pressure column 904. In FIGS. 5–7, this expanded feed air fraction, line 936, is fed to high pressure column 902.

In the cycle shown in FIG. 5, this fraction, line 930, is cooled in main heat exchanger 900 before expansion, while a fraction (corresponding to about 8–20% of feed air) of the elevated pressure nitrogen, line 134, is warmed to ambient temperature in heat exchanger 900 and isentropically expanded in expander 924 and warmed in heat exchanger 900 to supplement the refrigeration needs for cooling the feed air in the warm end of main heat exchanger 900. This warmed nitrogen is used as the mole sieve beds regeneration stream.

In the cycle shown in FIG. 6, the expanded air, line 935, is introduced into main heat exchanger 900 and cooled further before introduction into high pressure column 902, while regeneration nitrogen, line 134, (8–20% of feed air) is removed from main heat exchanger 900 before it is warmed to ambient temperature and isentropically expanded in expander 924. The expanded nitrogen is fed to the cold end of main heat exchanger 900.

In the cycle shown in FIG. 7, nitrogen fraction, line 134, is isentropically expanded in expander 924, warmed respectively in subcooler 918 and heat exchanger 900 and then used as regeneration stream. In FIG. 7, the inlet temperature and pressure to expanders 920 and 924 are the same. However, since the exhaust from expander 920 is not used for mole sieve beds regeneration, its pressure is about 1–3 psi lower than the discharge pressure of expander 924. This arrangement allows for a greater recovery of refrigeration and hence a greater production of liquid products. The expanded air, line 936, is fed to high pressure column 902 without further cooling.

Figure 8:
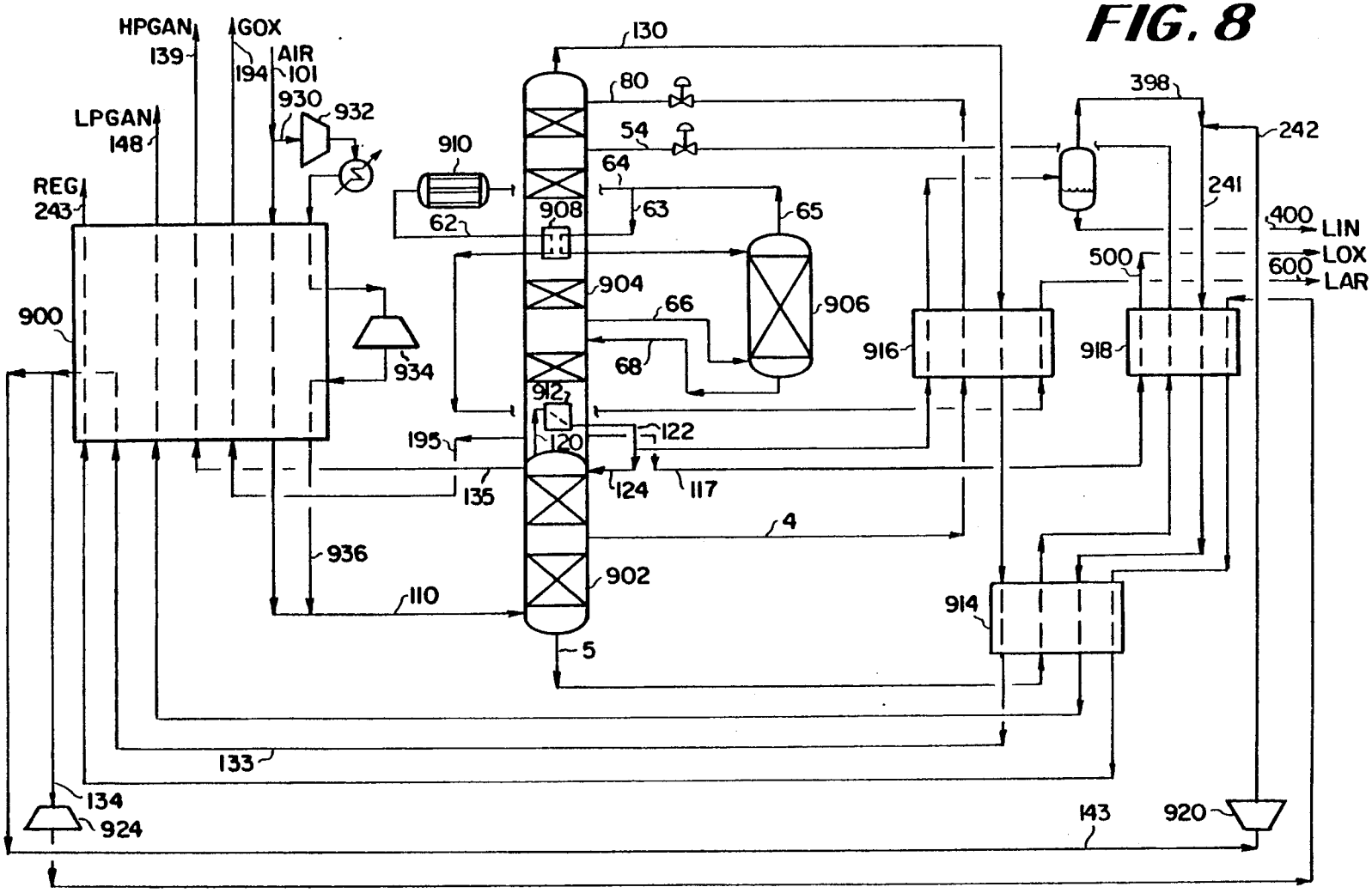

In the cycle shown in FIG. 8, all of the elevated pressure nitrogen, line 133, is isentropically expanded after being partially warmed in main heat exchanger 900. This expansion occurs in expanders 920 and 924.

The expanded nitrogen streams, lines 242 and 925, are then fed to subcooler 918 to subcool liquid stream, line 5, and then warmed in main heat exchanger 900. After being heated to ambient temperature, the stream expanded from 924, which is 8–20% of feed air, is used as the regeneration stream, line 243.

Figure 10:
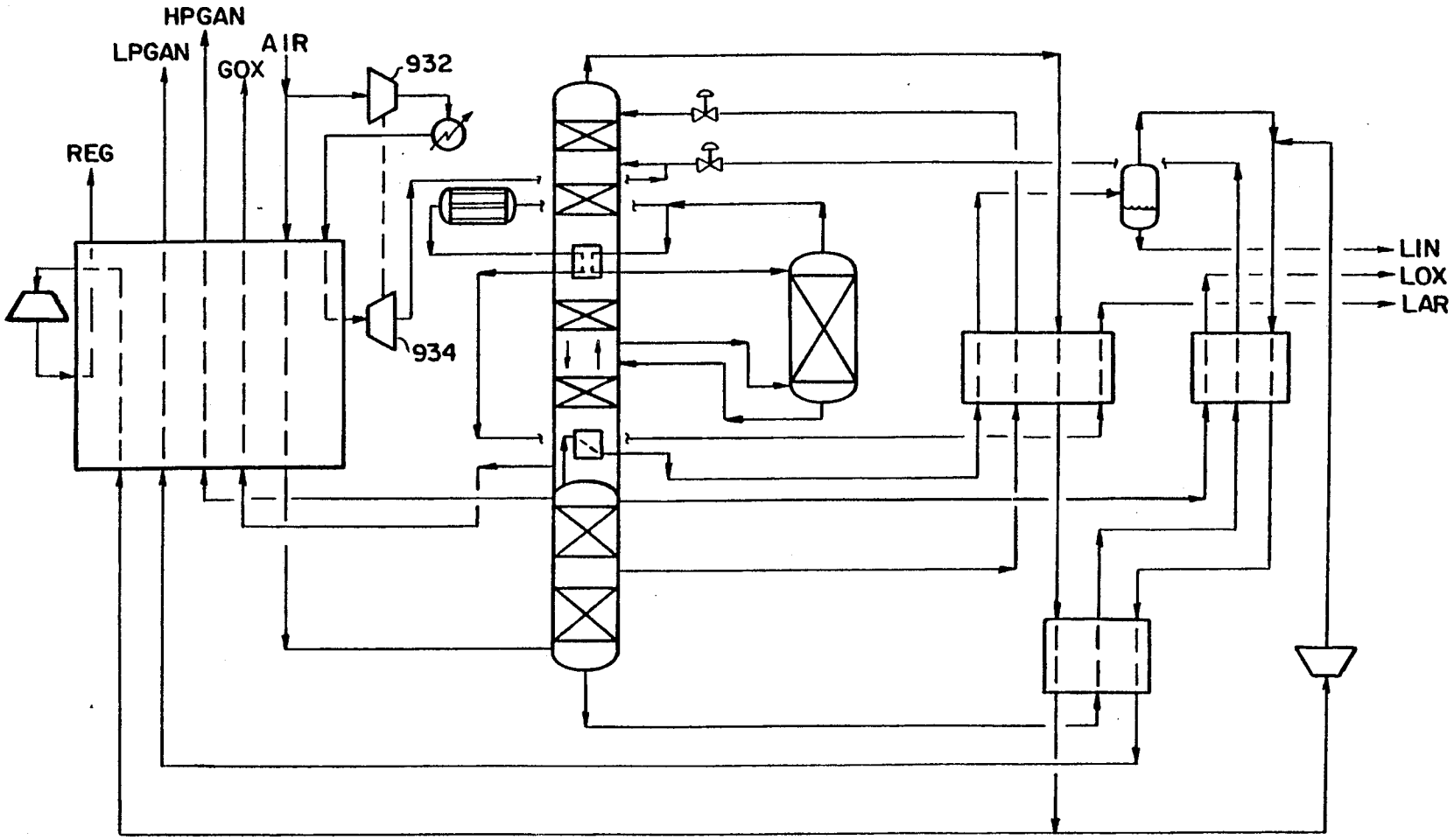

The cycles of FIGS. 5–8 are more advantageous than the cycle of FIG. 4 in terms of energy consumption and exchanger area. Among them, the cycle shown in FIG. 7 allows more liquid nitrogen product without seriously hurting oxygen and argon recoveries. If even more liquid is desired, the cycle shown in FIG. 8 is even more suitable. Compressor 932 is driven by air expander 934 or nitrogen expander 920 or 924 or any combination thereof. If argon recovery is not an important issue, then, in FIGS. 5–8, the expanded feed air fraction should be fed directly to low pressure column 904 (not shown). An example of such is shown in FIG. 10 in which the expanded air fraction is fed directly to the low pressure column. Also, in this Figure, air expander 934 and compressor 932 are mechanically linked to form a compander.

All of the above embodiments have been described with reference to cycles which produce argon. The taught concepts are useful when no argon is produced from the air separation plant.

EXAMPLE

Computer simulations were done for embodiments shown in FIGS. 1–4. The product specifications for simulations in this example are listed in Table 1.

TABLE 1

| Product | Production Rate: tons/day | Pressure: psia |
|---|---|---|
| Gaseous Oxygen | 2531 | 805 |
| Liquid Oxygen | 64 | — |
| Gaseous Nitrogen | 1.51 | >65 |
| Liquid Nitrogen | 255.35 | — |
| Liquid Argon | Maximum | — |

Purity:
Oxygen: >95% mol % oxygen
Nitrogen: <2 vppm oxygen

Figure 9:
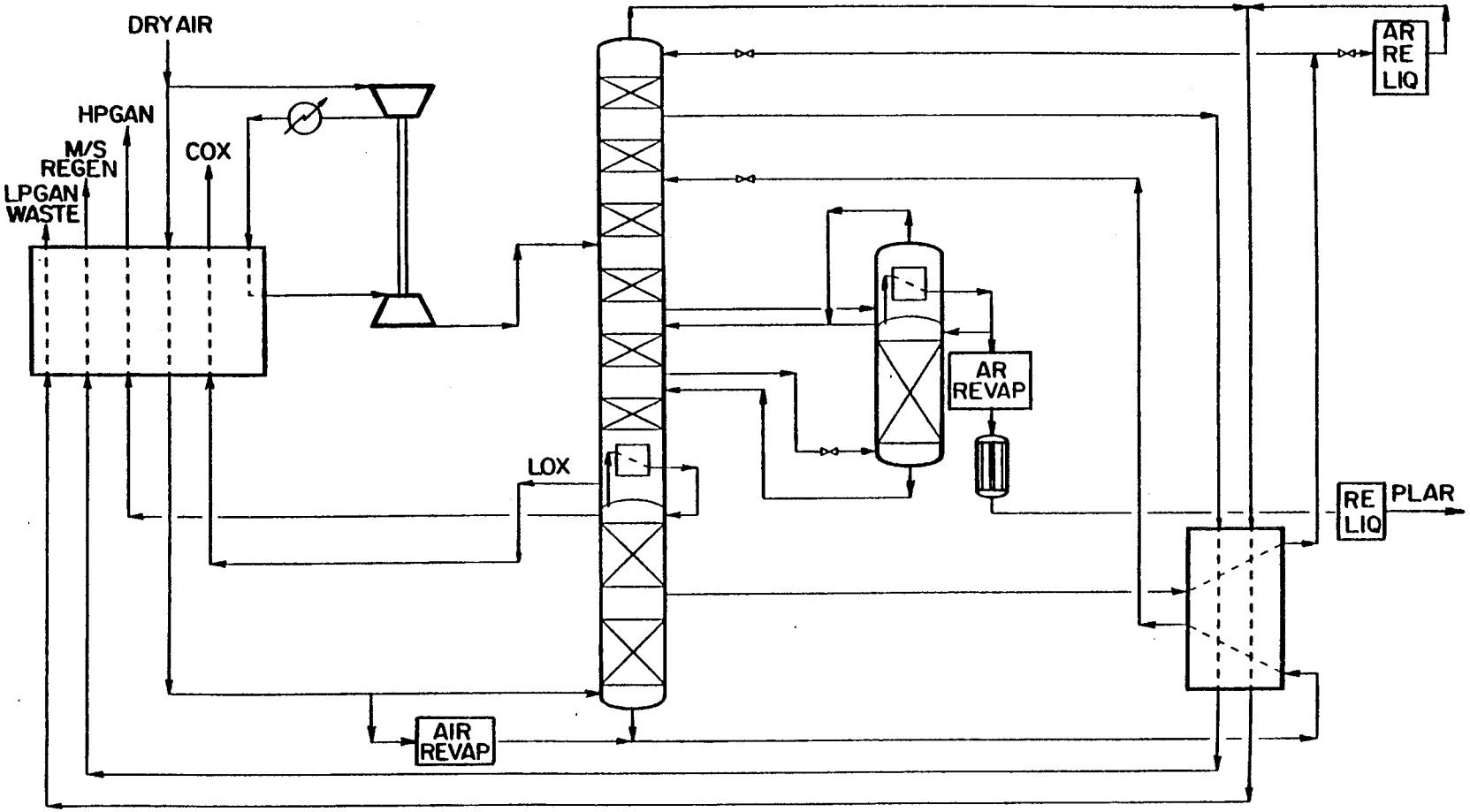
FIG. 9 PRIOR ART
FIG. 9 is a schematic diagram of a conventional air separation process.

Table 2 presents a comparison of different cycles. Recall that LEP, SEP, BEP and EP are the cycle designations for the embodiments shown in FIGS. 1–4, respectively. AirComp is the conventional low pressure air compander cycle in which both the water chilling stream and regeneration stream are produced directly from the low pressure column; this conventional cycle is shown in FIG. 9. Low pressure cycle Aircomp needs a liquefier for liquefying oxygen and nitrogen in order to produce the desired liquid products. See the note of Table 2. The liquefier is not shown in FIG. 9. In Table 2, oxygen recovery is defined as the moles of oxygen recovered per 100 moles of air feed to the distillation column system. The argon recovery is defined as the percentage of argon recovered which is present in the feed air to the distillation column system.

TABLE 2

| Cycle | MAC Discharge Recovery: Oxygen | MAC Discharge Recovery: Argon | KW (**) Pressure: psia | Power Consumption: MAC | Power Consumption: $O_2$ Comp |
|---|---|---|---|---|---|
| AirComp | 20.92 | 79.28 | 78.6 | 24,667 | 11,075 |
| DEP | 20.95 | 80.72 | 112.8 | 29,941 | 10,455 |
| SEP | 20.95 | 78.70 | 121.1 | 30,995 | 9,900 |
| BEP | 20.95 | 74.52 | 109.9 | 29,549 | 10,585 |
| EP | 20.95 | 95.89 | 121.9 | 31,078 | 10,087 |

| Cycle | Power Consumption: KW (**) $N_2$ Boost | Regen Boost | Liq+ | Expd++ | Total |
|---|---|---|---|---|---|
| AirComp | — | 856 | 4,875 | — | 41,473 |
| LEP | — | 723 | — | −1,705 | 39,414 |
| SEP | — | 723 | — | −1,708 | 39,911 |
| BEP | — | 723 | — | −1,591 | 39,166 |
| EP | 2,411 | 723 | — | −1,761 | 42,537 |

**Basis for Power Calculations

| Compressor | Compression Temperature °F. | Compressor Isothermal Efficiency: % | Motor Efficiency: % |
|---|---|---|---|
| MAC | 55 | 69.5 | 97 |
| Oxygen Comp | 51.5 | 65 | 95 |
| Nitrogen Boost | 51.5 | 65 | 95 |
| Air Boost | 51.5 | 69.5 | 95 |

Notes:
+Liquefier energy calculation: 390 KW/T of Liquid/HR for Air Comp, which needs a liquefier to produce liquid nitrogen and liquid oxygen.
++Expander efficiency = 0.85, shaft efficiency = 0.95, generator efficiency = 0.97

From Table 2 it can be seen that the elevated pressure cycles LEP, SEP, and BEP have lower power values than the Aircomp cycle, These power values are 3.8 to 5.5% lower than the conventional Aircomp cycle. The argon recovery for LEP cycle is comparable to Aircomp, and is slightly lower for SEP and BEP. The savings in capital cost and energy consumption, however, will far offset the drops in argon recovery. The EP cycle has higher power consumption, with a very high argon recovery. Process conditions for some of the pertinent streams for LEP, SEP, and BEP cycles are listed in Table 3.

TABLE 3

| | Stream Number 101 | 194 | 139 | 148 | 243 | 143 | 8 | 20 | 4 | 5 | 130 |
|---|---|---|---|---|---|---|---|---|---|---|---|
| **LEP Cycle (FIG. 1)** | | | | | | | | | | | |
| Flow: % of Air | 100 | 20.45 | 0.014 | 65.05 | 10.7 | 34.7 | 30.00 | 10.87 | 31.63 | 54.80 | 64.65 |
| Temperature: °F. | 55.0 | 51.5 | 51.5 | 51.5 | 51.5 | −274.5 | −245.9 | −134.6 | −281.1 | −273.0 | −308.1 |
| Pressure: psia | 109.4 | 20.3 | 104.6 | 15.1 | 16.7 | 30.3 | 29.8 | 106.0 | 106.4 | 107.1 | 30.6 |
| **SEP Cycle (FIG. 2)** | | | | | | | | | | | |
| Flow: % of Air | 100 | 20.45 | 0.014 | 65.06 | 10.86 | 64.80 | | 10.86 | 31.90 | 54.62 | 64.77 |
| Temperature: °F. | 55.0 | 51.5 | 51.5 | 51.5 | 51.5 | −275.0 | | −172.9 | −279.2 | −270.9 | −306.3 |
| Pressure: psia | 117.7 | 33.4 | 113.0 | 15.1 | 16.7 | 33.5 | | 114.4 | 114.8 | 115.5 | 37.8 |
| **BEP Cycle (FIG. 3)** | | | | | | | | | | | |
| Flow: % of Air | 100 | 20.45 | 0.014 | 65.08 | 10.87 | 64.40 | | 10.87 | 30.89 | 55.52 | 64.67 |
| Temperature: °F. | 55.0 | 51.5 | 51.5 | 51.5 | 51.5 | −249.0 | | −141.3 | −281.9 | −273.9 | −308.8 |

TABLE 3-continued

| | Stream Number | | | | | | | | | | |
|---|---|---|---|---|---|---|---|---|---|---|---|
| | 101 | 194 | 139 | 148 | 243 | 143 | 8 | 20 | 4 | 5 | 130 |
| Pressure: psia | 106.4 | 29.2 | 101.6 | 15.1 | 16.8 | 28.7 | | 103.0 | 103.5 | 104.2 | 29.5 |

As can be seen from the above discussion, the present invention works by expanding the nitrogen stream produced from the low pressure column of an air separation plant using an elevated pressure cycle at the right temperatures and using the generated refrigeration from the expanded stream at the appropriate location in the process, the energy inherent to this nitrogen stream can be used to produce liquid products in an efficient manner with a minimal capital cost increase. Also, by producing the regeneration stream from a separate expander, the expansion ratios of the expanders are optimized, so that the air compression energy is optimized.

In all the figures shown, the nitrogen stream from the top of low pressure column 904 is withdrawn and expanded in a prudent manner to recover refrigeration. Alternatively, this stream could be withdrawn from any suitable tray location in the rectifying section of low pressure column 904. In such a case, the nitrogen-rich stream drawn from the top of low pressure column 904 may be used as a product stream. Furthermore, in such a case, a portion of the liquid nitrogen stream, line 3, from the top of high pressure column 902 may be used to provide liquid reflux to low pressure column 904.

The present invention has a significant benefit by teaching efficient ways of producing liquid product from the pressure energy inherent in the nitrogen stream produced by the low pressure column of an elevated pressure cycle air separation plant. In the present invention, air separation and liquid production are integrated in a very efficient way. The elevated pressure cycle air separation process of the present invention reduces equipment size, pressure drop loss and air cleaning molecular sieve beds regeneration energy consumption while generating liquid products from the pressure energy of the nitrogen product. The process of the present invention also eliminates the need for separate compressors, heat exchangers and other equipment of a stand alone liquefier. An efficient way of doing this implies such cycles are superior to other cycles not only in capital cost, but also in energy efficiency. Such efficient combinations of elevated pressure air separation and liquefaction should therefore be the choice for air separation when liquid products are also demanded. The same idea is also applicable to other cryogenic gas separation processes. It should be mentioned that although such cycles alone will have difficulties in producing large quantities of liquid products in terms of the feed air, (e.g. exceeding 10% of feed air), the combination of such cycles with liquefiers still results in optimal efficiency as well as capital cost.

Once again, the embodiments described above have not exhausted the possible combinations of the concepts taught by the present invention. Therefore, these embodiments should not be viewed as a limitation on the scope of this invention. The scope of the present invention should be ascertained by the following claims.

What is claimed is:

1. In a cryogenic process for the separation of air into at least an oxygen product and a nitrogen product and of which at least a portion of the oxygen product is recovered as a liquid, and wherein the process utilizes a distillation column system having at least two distillation columns, a high pressure distillation column and a low pressure column, which are in thermal communications with each other, wherein the low pressure column operates at a pressure between 9 to 75 psig, wherein the low pressure column produces a low pressure nitrogen product that is at least a portion of the nitrogen product, wherein at least 50% of the feed air to the distillation column system is removed from the low pressure column as said low pressure nitrogen product and wherein said low pressure nitrogen product has a nitrogen concentration of at least 95% and is at a pressure of at least 9 psig, the improvement for producing liquid products in an efficient manner comprising the steps of:

(a) partially warming the low pressure nitrogen product by heat exchange against a suitable process stream;

(b) isentropically expanding this partially warmed, low pressure nitrogen product in an expander so as a result of this expansion the temperature of the expanded nitrogen is at a lower temperature than the temperature of liquid streams which are removed from the high pressure column; and (c) subcooling the liquid streams removed from the high pressure column by heat exchange against the isentropically expanded nitrogen prior to isenthalpic reduction of the pressures of such liquid streams across a valve.

2. In a cryogenic process for the separation of air into at least an oxygen product and a nitrogen product and of which at least a portion of the oxygen product is recovered as a liquid, and wherein the process utilizes a distillation column system having at least two distillation columns, a high pressure distillation column and a low pressure column, which are in thermal communication with each other, wherein the low pressure column operates at a pressure between 9 to 75 psig, wherein the low pressure column produces a low pressure nitrogen product that is at least a portion of the nitrogen product, wherein at least 50% of the feed air to the distillation column system is removed from the low pressure column as said low pressure nitrogen product and wherein said low pressure nitrogen product has a nitrogen concentration of at least 95% and is at a pressure of at least 9 psig, the improvement for producing liquid products in an efficient manner comprising the steps of:

(a) partially warming the low pressure nitrogen product by heat exchange against a suitable process stream;

(b) isentropically expanding this partially warmed, low pressure nitrogen product in an expander so as a result of this expansion the temperature of the expanded nitrogen is at or below the dew point of the feed air to the double column distillation system; and (c) cooling the feed air by heat exchange against the isentropically expanded nitrogen.

3. In a cryogenic process for the separation of air into at least an oxygen product and a nitrogen product and of which at least a portion of one of the products produced is recovered as a liquid, and wherein the process utilizes a distillation column system having at least two distillation columns, a high pressure distillation column and a low pressure column, which are in thermal communication with each other, wherein the low pressure column operates at a pressure between 9 to 75 psig, wherein the low pressure column produces a low pressure nitrogen product that is at least part of the nitrogen product, wherein at least 50% of the feed air to the distillation column system is removed from the low pressure column as said low pressure nitrogen product and wherein said low pressure nitrogen product has a nitrogen concentration of at least 95% and is at a pressure of at least 9 psig, the improvement for producing liquid products in an efficient manner comprising the steps of:

(a) partially warming the low pressure nitrogen product stream by heat exchange against a suitable process stream;

(b) dividing the partially warmed, low pressure nitrogen product into two substreams, a first substream and a second substream;

(c) isentropically expanding the first substream in an expander so as a result of this expansion the temperature of the expanded first substream is at a lower temperature than the temperature of liquid streams which are removed from the high pressure column;

(d) subcooling the liquid streams removed from the high pressure column by heat exchange against the isentropically expanded first substream prior to isenthalpic reduction of the pressures of such liquid streams across a valve;

(e) warming the second substream by heat exchange against a suitable process stream;

(f) isentropically expanding this partially warmed, second substream product in an expander so as a result of this expansion the temperature of the expanded second substream is at or below the dew point of the feed air to the double column distillation system; and (g) cooling the feed air by heat exchange against the isentropically expanded first and second substreams.

4. The process of claim 2 wherein the cooling of the feed air by heat exchange with the isentropically expanded nitrogen product of step (c) also partially condenses the feed air stream.

5. The process of claim 3 wherein the cooling of the feed air by heat exchange with the isentropically expanded second substream of step (g) also partially condenses the feed air stream.

6. The process of claim 3 which further comprises compressing and aftercooling the second substream prior to the isentropic expansion.

7. The process of claim 3 wherein at least a portion of the warmed isentropically expanded second substream of step (g) is used to regenerate mole sieve beds used to preclean the feed air stream.

8. The process of claim 3 wherein at least a portion of the isentropically expanded first substream of step (d) is used to regenerate mole sieve beds used to pre-clean the feed air stream.

9. The process of claim 1 wherein a portion of the warmed nitrogen of step (a) is isentropically expanded in a separate expander to a pressure which is between 1 to 3 psi lower than the discharge pressure of the isentropically expanded nitrogen of step (b) and wherein said isentropically expanded portion is used to regenerate mole sieve beds used to pre-clean the feed air stream.

10. The process of claim 2 wherein a portion of the warmed nitrogen of step (a) is isentropically expanded in a separate expander to a pressure which is between 1 to 3 psi lower than the discharge pressure of the isentropically expanded nitrogen of step (b) and wherein said isentropically expanded portion is used to regenerate mole sieve beds used to pre-clean the feed air stream.

* * * * *